United States Patent [19]

Barcza et al.

[11] Patent Number: 4,699,653

[45] Date of Patent: Oct. 13, 1987

[54] THERMAL PRODUCTION OF MAGNESIUM

[75] Inventors: Nicholas A. Barcza; Albert F. S. Schoukens, both of Johannesburg, South Africa

[73] Assignee: Council for Mineral Technology, Johannesburg, South Africa

[21] Appl. No.: 905,300

[22] Filed: Sep. 9, 1986

[30] Foreign Application Priority Data

Sep. 26, 1985 [ZA] South Africa ..... 85/7430

[51] Int. Cl.[4] ..... C22B 4/00; C21C 5/52

[52] U.S. Cl. ..... 75/10.19; 75/67 R

[58] Field of Search ..... 75/67 R, 10.19

[56] References Cited

U.S. PATENT DOCUMENTS 2,920,951 1/1960 Bretschneider ..... 75/67 R 3,404,078 10/1968 Goldberger ..... 75/10.19

4,543,122 9/1985 Bodenstein ..... 75/67 R

*Primary Examiner*—Peter D. Rosenberg

*Attorney, Agent, or Firm*—Christie,Parker & Hale

[57] ABSTRACT

A process is provided for the production of magnesium from magnesium oxide, generally in the form of calcined dolomite, in which magnesium vapor is produced in a heated reaction zone from solid reactants fed substantially continuously to such reaction zone. The solid reactants include a reductant and optionally a slag forming agent, preferably ferrosilicon and alumina respectively. The reaction zone is heated by a thermal plasma, the electrical current of which includes the furnace bath as an integral part of it. The plasma forming gas is preferably argon.

8 Claims, 1 Drawing Figure

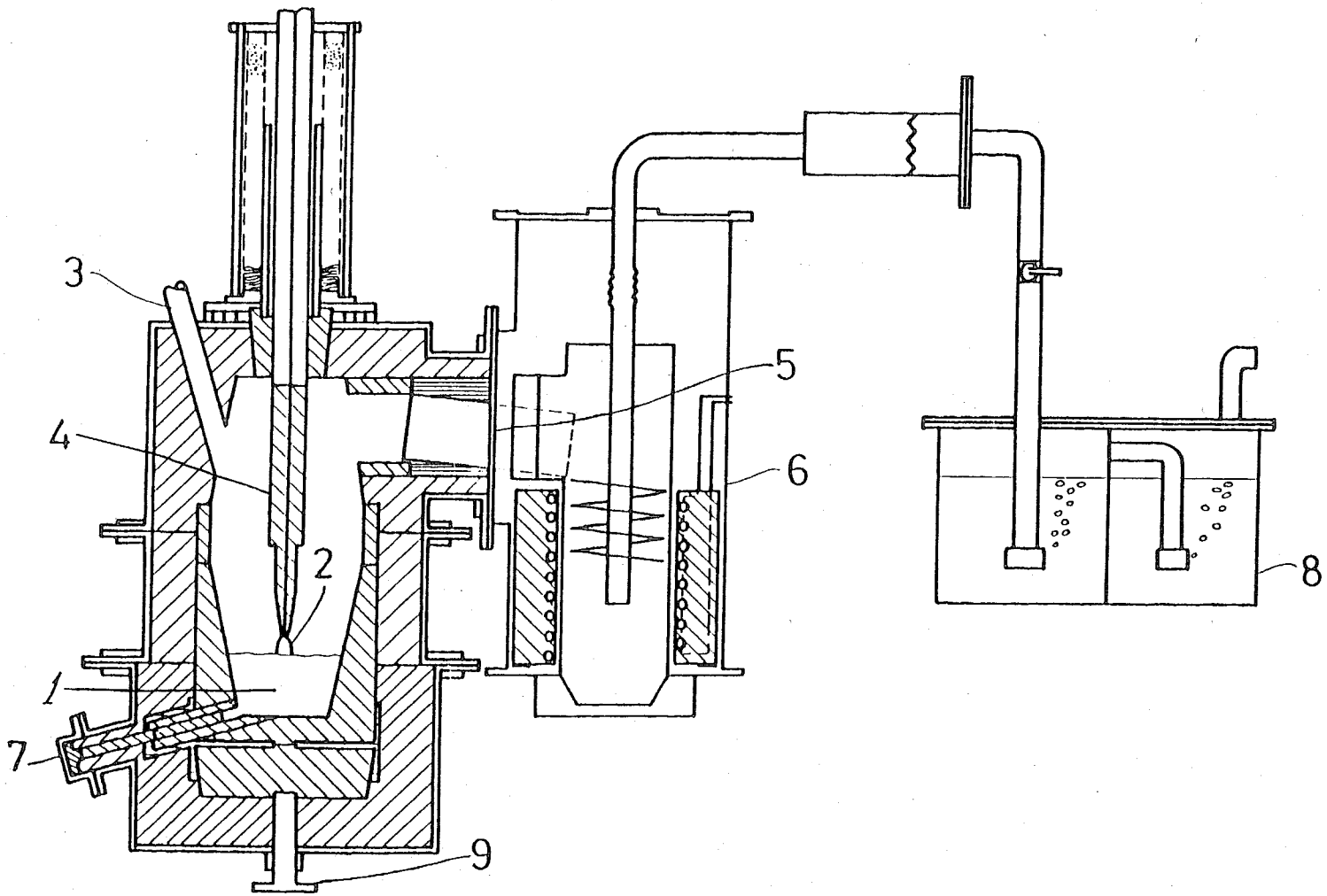
8
5
6
9
2
3
4
1
7

THERMAL PRODUCTION OF MAGNESIUM

FIELD OF THE INVENTION

This invention relates to a method for the thermal production of magnesium, and more particularly from magnesium oxide containing feed materials using a process involving silicon as at least one reductant.

BACKGROUND TO THE INVENTION

A number of methods are presently used for the production of magnesium but only the thermal processes are of concern in this specification. One of the earlier processes is the Pidgeon process in which calcined dolomite and silicon, usually in the form of ferrosilicon are briquetted then charged into tubular, steel retorts and are then reacted. The energy required for the reaction is supplied externally of the tubular retorts. Temperatures of about 1450° K. and pressures of below 14 Pa are commonly employed. The reaction is a solid state reaction with magnesium vapour being the product. The Pidgeon process suffers the disadvantage of low production capacity per unit and high maintenance costs.

Another of the earlier thermal processes to be developed is the carbothermic process. This process is based on the reaction of magnesium oxide with carbon to produce magnesium vapour. This process generally requires quenching of the magnesium vapour which produces magnesium powder and subsequent powder handling problems. South African Pat. No. 84/9885 describes an improvement to this process.

One of the later developments is the Magnetherm process. In this process, calcined dolomite is reacted with ferrosilicon, in the presence of alumina, in a submerged-arc reactor. The reaction with the ferrosilicon takes place in the molten state at or near the slag surface, which is generally above the thermal energy source which is generated by a submerged electrode. Thermal energy reaches the reaction zone by convection and conduction. The temperature within the reactor is normally in the region of 1820° K. while pressures are normally below 4 kPa. This process suffers the disadvantage that the thermal energy source is below the reaction zone and, in consequence, slagging agents such as alumina or bauxite flux are preferably introduced to reduce slag liquidus temperature and viscosity, with resultant increased turbulence, mixing and heat transfer while staying within the constraints of sufficient electrical resistivity of slag and sufficient ferrosilicon holdup in the slag. Operation under vacuum increases leakage problems and dictates batch operation in practice. South African Pat. No. 84/7540 describes such a process as applied to reject slags of other pyrometallurgical processes.

It is accordingly an object of this invention to provide a process for the continuous production of magnesium which alleviates at least some of the problems of a process such as the Magnetherm process.

SUMMARY OF THE INVENTION

In accordance with this invention there is provided a process for the continuous production of magnesium in a furnace bath wherein solid feed materials including at least some magnesium oxide and at least some reducing agent are fed at a controlled rate to a reaction zone in the furnace bath, the reaction zone consisting of at least molten slag in which gaseous magnesium is produced the magnesium vapour being recovered as required, the process being characterised in that the reaction zone and furnace bath are directly heated by means of a transferred-arc thermal plasma in respect of which the furnace bath forms an integral part of the electrical circuit, the heating being effected to a temperature at least above the minimum temperature for the reduction reaction of magnesium oxide.

Preferably the feed materials comprise completely calcined and optionally preheated dolomite and either ferrosilicon or alternatively silicon and/or aluminium and optionally alumina containing material. Such feed materials preferably comprise about 77% by mass of calcined dolomite, about 13% by mass of ferrosilicon and about 10% by mass of alumina.

A further feature of the invention provides for pure argon to be preferably used as the furnace plasma forming gas and furthermore for argon to be used as a purging or sweeping gas.

Still a further feature of the invention provides for the furnace to be operated at or near atmospheric pressure.

Yet further features of the invention provide for the transferred-arc thermal plasma to be generated by direct current or alternating current power supply; for the electrode or plasma generator to be mounted in any suitable geometrical arrangement above the furnace bath; and for the furnace to be associated with a magnesium recovery circuit.

It is envisaged that in the case of direct current operation reversed polarity (ie. the electrode is the anode instead of the cathode) may well be advantageous to the volatilization of the magnesium.

It will be appreciated that in this specification the term "thermal plasma" is intended to mean an electrically generated gaseous plasma in which the ion temperature lies between 5000° K. and 20,000° K. and wherein the furnace bath forms an integral part of the electrical circuit.

BRIEF DESCRIPTION OF THE DRAWING

An embodiment of the invention is described, by way of example only, with reference to the accompanying drawing in which a transferred-arc thermal plasma furnace and condenser for magnesium recovery are illustrated.

DETAILED DESCRIPTION OF THE EXAMPLE OF THE INVENTION

In general it is envisaged that the process may be applied to standard Magnetherm feeds that is, calcined dolomite, ferrosilicon and alumina containing material. Referring to FIG. 1, suitable proportions of said feed material are fed directly into the reaction zone 1 of a transferred-arc plasma 2 at a controlled rate through the feed inlet 3. The reaction zone is heated by an electrically-generated, argon plasma which is directed into the reactor from a central, hollow, graphite electrode 4. The outlet 5 is interfaced with a vessel 6 suitable for collecting magnesium or combustion of magnesium for subsequent collection as magnesium oxide (not shown).

The temperature of the reaction zone is preferably in the region of 1950° K. while the pressure is preferably atmospheric. It will be appreciated that the direct application of the plasma to the reaction zone allows the reaction zone to be heated to very high temperatures, thus obviating, even at low argon flow rates, the necessity for undesirable vacuum conditions.

Spent ferrosilicon and slag may be continuously removed from the system by suitably positioned outlet 7 while the magnesium vapour formed may be passed to a magnesium recovery unit which, for experimental purposes, was a condenser, a filter and an acid trap 8 to permit a complete magnesium mass balance to be made.

It will be appreciated that the reaction is carried out in an argon atmosphere and that the reactor is substantially leak proof.

Electrical contact is maintained with the bath via a counter electrode or anode 9, the bath accordingly forming an integral part of the electrical circuit.

In order that the invention may be better understood, experimental tests conducted to date will be discussed below and the results given.

EXAMPLE

The test equipment employed was a transferred-arc plasma furnace which consists of a 50 kVA direct current power supply and a reactor having rated capacity in the region of 1 kg of magnesium produced per hour. The electrode 4 which is in this case the cathode has its axial hole therethrough for the supply of argon gas. The unit operatively utilised 60 V and 700 A and hence generated a power of approximately 40 kW. The anodic electrode for the plasma arc is the reactor bath itself as indicated above.

The raw materials used for the test work were calcined dolomite, ferrosilicon and alumina. The total raw material feed rate was about 5 kg/hr in the mass ratio of 77% calcined dolomite, 13% ferrosilicon and 10% alumina. The total raw material fed to the reaction zone by means of two sealed feed hoppers each connected to a spiral feed of the Monaci type (for further details of which see South African Pat. No. 84/0994).

The actual compositions of the raw materials are given in Table 1.

TABLE 1

Chemical Analysis of the raw material feed mass per cent.

| Feed | MgO | CaO | $SiO_2$ | $Al_2O_3$ | FeO |
|---|---|---|---|---|---|
| Calcined Dolomite | 37,7 | 54,6 | 1,0 | 0,5 | 0,4 |
| Alumina | | | | 99,4 | |
| | Si | Fe | Al | C | Ca |
| Ferro-Silicon | 74,8 | 18,0 | 2,2 | 0,2 | 0,3 |

Argon was fed to the reactor at a total rate of 0.6 $m^3$/hr as a sweeping, purging and plasma supporting gas.

The gas pressure within the reactor was maintained near atmospheric, that is approximately 85 kPa, and the partial pressures, of the argon and magnesium gas were maintained in the approximate ratio of 1 to 1. The temperature of the reaction zone, although it could not be accurately determined, was expected to be in the region of 1950 K.

The magnesium vapour was condensed in the vessel 6 to produce magnesium metal. Analysis of the crude condensed magnesium indicated that a high purity level of 99.8% is attainable by thermal reduction in the plasma operated process. This metal can be further refined to remove entrained calcium and oxides. A noteworthy further advantage of working at atmospheric pressure is the suppression of unwanted vaporation of manganese and silicon which are typically present in amounts of 0.03 and 0.02 per cent respectively. These are lower than the values for the Magnetherm process. Thus magnesia bearing material with higher manganese contents can be utilized in this process than would otherwise be the case.

The actual composition of the condensed magnesium metal is given in Table 2.

TABLE 2

Chemical Analysis of Condensed Magnesium product.

| Test No. | Mg | Ca | Si | Al | Fe | Mn |
|---|---|---|---|---|---|---|
| | Composition by mass % | | | | | |
| 1. | 99,81 | 0,10 | 0,03 | 0,01 | 0,01 | 0,02 |
| 2. | 99,84 | 0,08 | 0,02 | 0,01 | 0,01 | 0,03 |
| 3. | 99,80 | 0,09 | 0,02 | 0,02 | 0,02 | 0,04 |
| 4. | 99,80 | 0,10 | 0,02 | 0,02 | 0,02 | 0,02 |

The composition of the slag for each test is given in Table 3.

TABLE 3

Chemical Analysis of the produced slags.

| Test No. | MgO | CaO | $SiO_2$ | $Al_2O_3$ |
|---|---|---|---|---|
| | Composition by mass % | | | |
| 1. | 7,9 | 53,3 | 23,3 | 12,7 |
| 2. | 8,5 | 52,5 | 24,6 | 10,9 |
| 3. | 4,7 | 56,2 | 22,3 | 12,9 |
| 4. | 6,3 | 47,7 | 31,9 | 10,8 |

A magnesium recovery was calculated for each Test as follows:

$$\% \text{ Mg vapour produced} = \frac{\text{Mg in feed} - \text{Mg in slag}}{\text{Mg in feed}} \times 100$$

$$\text{Condenser efficiency} = \frac{\text{Mg condensed}}{\text{Mg vapour produced}}$$

The magnesium recovery results are given in Table 4.

TABLE 4

Magnesium recovery by mass %

| Test No. | Mg vapour produced | Condenser efficiency |
|---|---|---|
| 1. | 78 | 38 |
| 2. | 75 | 57 |
| 3. | 89 | 64 |
| 4. | 83 | 29* |

*Magnesium was lost by combustion in this test when the condenser was opened.

The recovery results for Mg vapour produced, compare favourably with the 83% recovery reported for the Magnetherm process when the scale of these tests are borne in mind and the batch nature of the test is considered.

It will be understood that the exact conditions in the reactor must be selected according to requirements and, as a result, appreciable test work and research may be found to be necessary to determine optimum conditions within the framework of this invention.

It will be appreciated that the use of a transferred-arc plasma furnace results in the direct application of thermal energy to the reaction zone of the reactor. Sufficiently high temperatures hence may be maintained in this zone offering the advantage of operation at atmospheric conditions. Furthermore, the viscosity and electrical resistivity of the slag become variables of less importance than in the conventional Magnetherm process and hence the alumina addition can be reduced or even dispensed with. The invention thus offers a convenient process for the thermal production of magnesium which alleviates the vacuum leak problems of prior art processes and which may permit continuous operation.

It will be understood that numerous variations may be made to the invention without departing from the scope hereof, for example the raw material feed mixture may contain other sources of magnesium oxide such as metallurgical slags, calcined magnesia or calcined serpentine, or alternatively, other reducing agents such as aluminium, calcium, carbon, silicon or combinations thereof may be employed, or alternatively, the furnace may contain a water-cooled tungsten electrode or a composite copper and graphite electrode that can be progressively extended into the reactor to accommodate electrode wear or the furnace may operate on alternating current. The invention is limited only to a process for the production of magnesium in a furnace bath wherein feed materials including at least some magnesium oxide and at least some reducing agents are each fed, at a controlled rate, to a reaction zone in the bath, the reaction zone comprising at least molten slag which is directly heated by means of a transferred-arc thermal plasma to a temperature and at least above the minimum temperature for reaction.

We claim:

1. A process for the continuous production of magnesium in a furnance bath comprising:

feeding solid feed materials including at least some magnesium oxide and at least some reducing agent at a controlled rate to a reaction zone in the furnance bath, the reaction zone comprising molten slag in which gaseous magnesium is produced;

heating the reaction zone directly by means of a tranferred-arc thermal plasma wherein the furnace bath forms an integral part of the electrical circuit, such heating being effected to a temperature at least above the minimum temperature for the reduction reaction of magnesium oxide and the maintenance of a molten slag phase; and recovering the magnesium vapour thus formed.

2. A process as claimed in claim 1 in which the solid feed materials comprises calcined dolomite.

3. A process as claimed in either of claim 1 in which the reducing agent includes ferrosilicon or aluminium or both of such reducing agents.

4. A process as claimed in claim 1 in which one or more of the feed materials are preheated prior to feeding to the reaction zone.

5. A process as claimed in claim 1 in which the necessary plasma forming gas is argon.

6. A process as claimed in claim 5 in which argon is used as a purging or sweeping gas for ensuring the exclusion of atmospheric oxygen.

7. A process as claimed in claim 1 in which the pressure within the furnace is roughly atmospheric pressure.

8. A process as claimed in claim 1 in which the feed materials comprise, in mass percentages, about 77% of calcined dolomite, about 13% of ferrosilicon and about 10% of alumina.

* * * * *